United States Patent [19]

Simpson

[11] Patent Number: 4,961,388

[45] Date of Patent: Oct. 9, 1990

[54] CLOSET IRONING TABLE

[75] Inventor: Danny Simpson, Seymour, Ind.

[73] Assignee: Lear Siegler Commercial Products Corp., Seymour, Ind.

[21] Appl. No.: 297,092

[22] Filed: Jan. 13, 1989

[51] Int. Cl.[5] ..... A47B 23/00

[52] U.S. Cl. ..... 108/42; 108/48; 108/134

[58] Field of Search ..... 108/42, 47, 48, 33, 108/34, 40, 134; 248/121, 122; 312/314, 316, 313

[56] References Cited

U.S. PATENT DOCUMENTS

| | | | |
|---|---|---|---|
| 1,213,475 | 1/1917 | Gardner | 108/33 |
| 1,506,240 | 8/1924 | Ives | 108/134 |
| 1,595,628 | 8/1926 | Small | 108/48 |
| 1,677,162 | 7/1928 | Adams | 108/33 |
| 1,833,997 | 12/1931 | Koobler | 108/39 |
| 3,080,832 | 3/1963 | Schroemges | 108/134 X |

*Primary Examiner*—Jose V. Chen

*Attorney, Agent, or Firm*—Reising, Ethington, Barnard, Perry & Milton

[57] ABSTRACT

An ironing table assembly (10) of the type for movement between stored and work positions and particularly adapted for fixed connection in a closet (12). The assembly (10) includes a support member (20) which may be secured to the closet floor (16) and the closet rod (14). A pivot member (48) is pivotally secured to the tubular member and presents a tubular portion (54). A table (42) is included and has a guide rod (58) depending therefrom. The guide rod (58) is slideably retained in the tubular portion (54). An arm (62) is pivotally connected to the tubular support member (20) at one end and is pivotally mounted to the bottom of the table (42) at the other end. The arm (62) guides rotational and translational movement of the table (42) in a fore and aft (Y-Z) plane from the upper stored position to a knife edge position. The table is then rotated to a lateral (X-Z) plane to the lower work position. A socket member (66) limits rotational movement of the board from the knife edge to the working position.

20 Claims, 2 Drawing Sheets

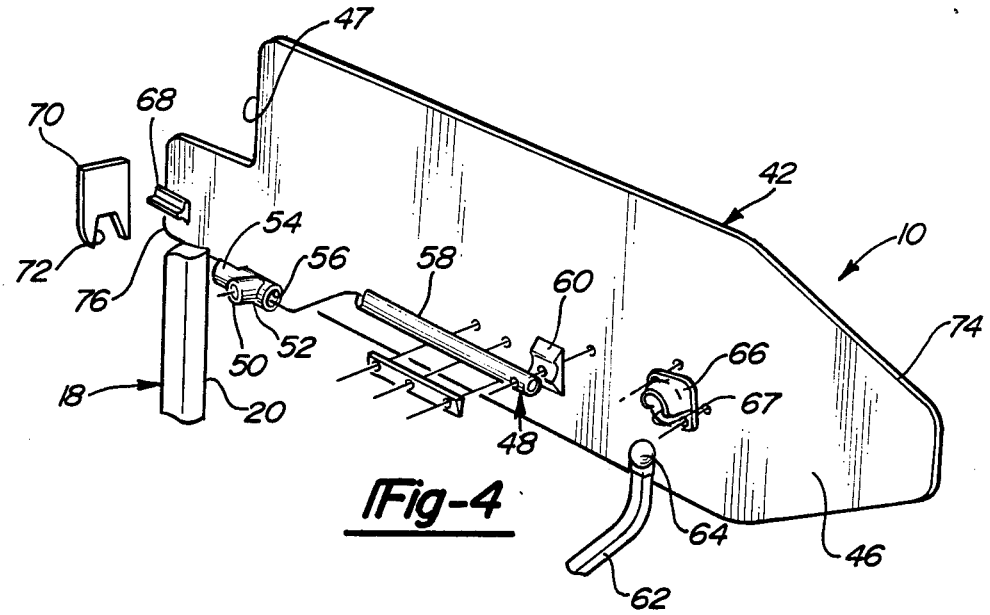
Fig-4
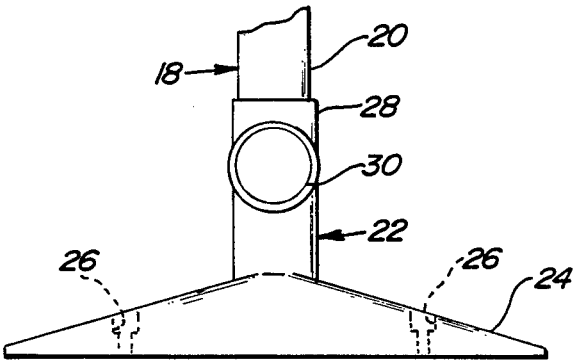
Fig-5
Fig-6
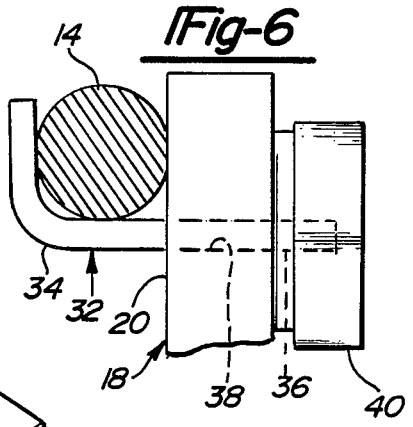
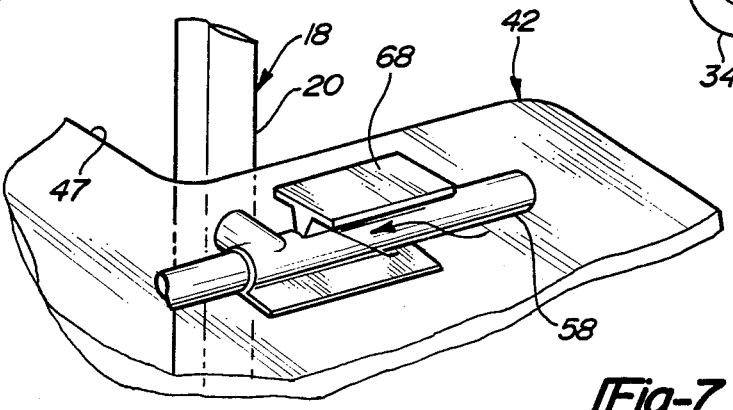
Fig-7

CLOSET IRONING TABLE

TECHNICAL FIELD

The present invention relates to ironing tables. More specifically, the present invention relates to an ironing table which is particularly well adapted for fixed storage in a closet.

BACKGROUND OF THE INVENTION

It is desirable to have an ironing table or board assembly which is compact and can be folded into a closet. It is particularly advantageous if the board can be stored in the closet in such a manner as to occupy minimal space when stored. It is further preferable that the table can be folded outwardly away from the closet to present an ironing surface adjacent the closet opening.

Previous ironing tables which were stored in closets generally needed to be stored inside a space dedicated solely to the ironing table. Typically, the table was secured inside the closet by being hinged at the rearmost end of the board. As the closet was opened, the board could be rotated downwardly to an ironing position. This style of board is disadvantageous in that it was necessary to have a closet dedicated only to the ironing table assembly. Further, the table assembly is fixedly secured within a wall and cannot be moved once installed.

SUMMARY OF THE INVENTION AND ADVANTAGES

According to the present invention, there is provided an ironing table assembly for movement between stored and work positions. The assembly comprises support means. The assembly further comprises ironing table means for moving between an upright stored position and a horizontal work position. The assembly is characterized by pivot means interconnecting the support means and the table means for storing the table means longitudinally upright in a vertical fore and aft plane. The pivot means is further for allowing forward pivotal movement about a transverse lateral axis while simultaneously allowing translational movement in said fore and aft plane. The pivot means further allows rotational movement of the table means about a transverse fore and aft axis from a knife edge position to a horizontal work position.

Accordingly, there is provided an ironing table which is easily adaptable for mounting in a closet and having a thin profile when stored in the closet so as to not occupy a large amount of space. Further, the table can be rotated outwardly from the closet to present a horizontal working position adjacent the closet opening for ironing on the table.

BRIEF DESCRIPTION OF THE DRAWINGS

Other advantages of the present invention will be readily appreciated as the same becomes better understood by reference to the following detailed description when considered in connection with the accompanying drawings wherein:

FIG. 4 is a exploded view of the ironing table;

FIG. 5 is a front view partially broken away taken along line 5—5 of FIG. 1;

FIG. 6 is a side view partially broken away and partially in cross section taken along line 6—6 of FIG. 1; and FIG. 7 is a plan view partially broken away of the rear portion of the ironing table.

DETAILED DESCRIPTION OF THE DRAWINGS

An ironing table assembly for movement between stored and work positions is generally shown at 10 in the Figures.

Figure 3:
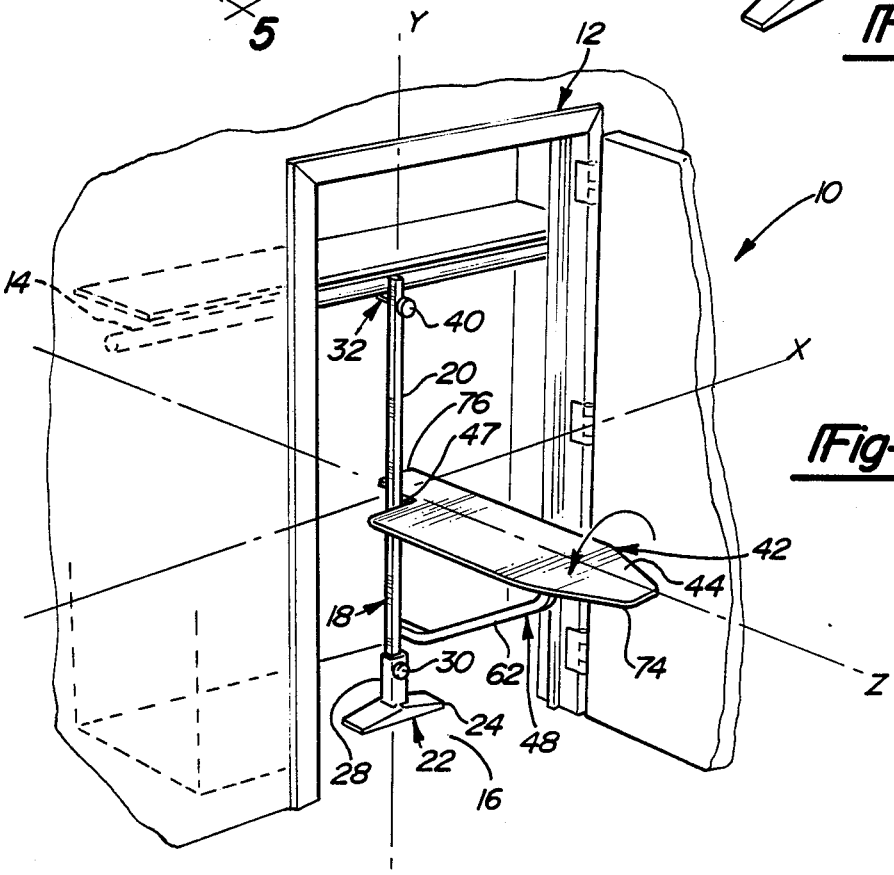
FIG. 3 is an environmental perspective view of the subject ironing table in the horizontal work position.

Referring to FIG. 3, the ironing table assembly 10 is particularly well adapted for storage in a closet generally indicated at 12. Preferably, the closet has an upper support or closet rod 14 and a lower support or floor 16.

The assembly 10 includes support means generally indicated at 18. The support means 18 comprises a tubular support member 20 As shown in the Figures, the support member 20 preferably has a square or rectangular cross section. The square or rectangular cross section helps prevent rotating movement of the tubular support member 20. It is appreciated, however, that the support member 20 is not limited to having a square or rectangular cross section and can have any shape cross section such as, for example, circular The support means 18 further includes height adjustment means generally indicated at 22. The height adjustment means 22 includes a foot member 24 as best seen in FIG. 5. The foot member 24 is adapted for resting on and/or fixed connection to the floor 16 of the closet 12. Specifically, the foot member 24 has a flat bottom for resting on the floor 16. The foot member 24 further has a pair of holes 26 therethrough for placing a fastener, such as a screw therethrough for securing the foot 24 to the floor 16. It is appreciated that the foot member 24 can rest on the floor 16 without the need for fastening the foot 24 to the floor in the fixed manner. In other words, the foot member 24 can lay atop the floor 16.

The height adjustment means 22 further includes an upright member 28 extending upwardly and transverse to the base 24. The upright member 28 has an inner configuration adapted for mating engagement with the outer configuration of the tubular support member 20. In the preferred embodiment, the upright member 28 has a square or rectangular cross section The tubular support member 20 is retained within the upright member 28. A knob 30 having a male threaded portion thereon extends through a threaded opening in the upright member 28 and into engagement with the tubular support member 28. The end of male threaded portion extending from the knob 30 frictionally engages the tubular support member 20. Once the support member 20 is inserted into the upright member 28, the knob 30 is tightened to secure the tubular support member 20 within the upright member 28. By tightening the knob 30, relative motion between tubular support member 20 and the upright member 28 is prevented. In this manner, the tubular support member 20 can be adjusted to a desired height and then the knob 30 tightened for securing the tubular support member 20.

The support means 18 further includes clamping means generally indicated at 32. As best seen in FIG. 6, the clamping means includes a hook member 34. The hook member 34 has a hook portion adapted for engaging the rod 14 of the closet 12. Further, the hook member 34 has a threaded portion 36. The threaded portion 36 extends through an opening 38 in the tubular support member 20. A clamping handle 40 has a female threaded portion for mating engagement with the male threaded portion of the hook member 34. To secure the clamping means 32 to the closet rod 14, the hook member 34 is placed about the rod 14. The threaded portion 36 is then inserted through a hole 38 in the tubular support member 20, such that the rod 14 is disposed between the hook portion and the support 20. The clamping handle 40 is then threaded onto the threaded portion 36 of the hook member 34. The clamping handle 40 is tightened until sufficient pressure is exerted on the member 34 thereby frictionally retaining or sandwiching the rod 14 between the hook member 34 and the tubular support member 22. With this connection made, the hook member 34 is fixedly secured to the closet rod 14. As shown in FIG. 6, the hook member 34 presents an upwardly facing gap for receiving the closet rod 14. The hook member 34 can be rotated to present a downwardly facing gap for receiving the closet rod 14. This provides further effective height adjustment of the support member 20.

Figure 1:
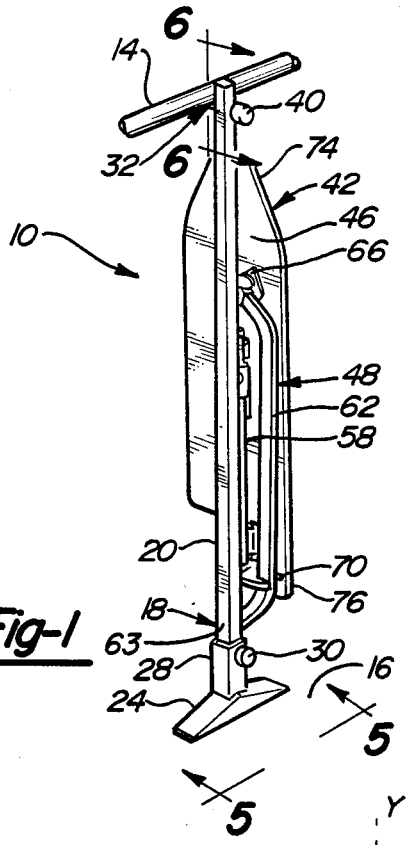
FIG. 1 is a perspective view of the subject ironing table in the upright stored position.

The assembly 10 further includes table means generally indicated at 42. The table means 42 is for moving between an upright stored position, as best shown in FIG. 1, and a horizontal work position as best shown in FIG. 3. The table means 42 includes a table or board 42 having a top side 44 and a bottom side 46. Further, the table 42 has forward 74 and rear 76 portions. The forward portion 74 of the table 42 extends outwardly and away from the tubular support member 20 when the board 42 is in the horizontal work position as best shown in FIG. 3. The rear portion 76 of the table is located adjacent of the tubular support member 20 when the table 42 is in the lower work position The rear portion 76 of the board 42 has a recess 47 therein The tubular support member 20 is disposed within the recess 47 when the table 42 is in the horizontal work position (as best viewed in FIG. 3).

The assembly 10 further includes pivot means generally indicated at 48. The pivot means 48 interconnects the tubular support member 20 with the table 42 for storing the table 42 longitudinally upright in a vertical fore and aft plane as best viewed in FIG. 1. Reference is specifically made to FIG. 3 wherein a coordinate set of axes is superimposed. The fore and aft plane is a plane defined by a plane parallel to the plane defined by the Y-Z axes and will hereinafter be referred to as the Y-Z plane. The pivot means 48 further allows forward pivotal movement of the table 42 about a transverse lateral axis (the Y axis as viewed in FIG. 3). This initial forward pivotal movement takes place only in the fore and aft (Y-Z) plane. As the table 42 is pivoted forwardly, the table 42 translates or moves outwardly away from the support 20. This translational movement also occurs only in the fore and aft (Y-Z) plane. Finally, the pivot means allows rotational movement about a transverse fore and aft axis (the Z axis as viewed in FIG. 3) from a knife edge position as (best shown in FIG. 4) to the horizontal work position (as best shown in FIG. 3). The knife edge position is defined by the edge of the table 42 being in the Y-Z plane and the longitudinal axis of the board is substantially parallel to the Z axis. In other words, the knife edge position is obtained when the board is downwardly pivoted from the stored position (FIG. 1) until the longitudinal axis of table 42 is substantially perpendicular to the tubular support 20, and the table 42 has not yet been pivoted to the work position (i.e., the table 42 is on edge). It is appreciated that the knife edge position occurs when or slightly before the table 42 is perpendicular to the tubular support 20. Thus, the final movement from the knife edge position to the work position may comprise a slight rotation about the X axis as the table 42 is being rotated to the lower work position (FIG. 3) and the table 42 is in the X-Z plane.

Specifically, the pivot means includes guide means for rotational attachment to the support member 20. The guide means includes a first tubular portion 50. The tubular portion 50 has an opening 52 therethrough. The opening is for retaining a fastener (not shown), such as a rivet, therein. It is appreciated that any suitable fastener can be used. The rivet extends between the tubular support member 20 and the first tubular portion 50 and permits relative rotational movement between the first tubular portion 50 and tubular support member 20.

The guide means further includes a second tubular portion 54. The second tubular portion 54 is transverse to the first tubular portion 50 and is fixedly secured thereto That is, the first tubular portion 50 and second tubular position 54 are integral. The second tubular portion 54 has a bore 56 therethrough and is for slideably connecting the second tubular portion with the table 42 as will be described in greater detail subsequently.

The pivot means 48 further includes track means for fixed attachment to the bottom side 46 of the table 42. The track means includes a rod 58 fixedly secured to the bottom side 46 of the table 42 and spaced therefrom. Specifically, a pair of bushings 60 are fixedly attached to the bottom side 46 of the table 42. The rod 58 is retained in the bushings 60 and depends therefrom. The rear bushing 60 defines the extent of relative translational movement between the table 42 and the tubular support member 20 as will be described in greater detail subsequently. The rod 58 extends generally parallel the longitudinal axis of the table 42 and is spaced therefrom.

The rod 58 is slideably retained within the bore 56 of the second tubular portion 54. Thus, the rod 58 is free to slide relative to the tubular portion 54. Said another way, there is relative sliding movement between the second tubular portion 54 and the rod 58 to allow translational movement of the table 42 in the fore and aft plane (X-Z plane as viewed in FIG. 3) relative to the tubular support member 20. The extent of translational movement is defined by the rear bushing 60.

The pivot means 48 further includes an arm 62 for guiding the forward pivotal movement and the forward translational movement in the fore and aft plane (Y-Z plane, as viewed in FIG. 3) and for guiding the rotational movement of the table 42 between the knife edge position and the horizontal work position. The arm 62 has first and second ends The first end of the arm 62 is pivotally secured to the tubular support member 20. This can be accomplished in a variety of suitable ways. However, it is preferred that the first end of the arm 62 be secured to the tubular support member 20 by utilizing a rivet 63 which extends through the arm 62 and through the tubular support 20. The rivet permits relative rotational movement between the arm 62 and tubular support 20. The second end of the arm 62 has a ball member 64 thereon.

The assembly 10 includes stop means for limiting pivoting movement of the table 42 from the knife edge position to the horizontal work position The stop means includes a socket member 66 fixedly secured on the bottom side 46 of the table 42. The ball member 64 on the arm 62 is pivotally retained by the socket member 66. The socket member 66 has a groove or seat 67 therein. The groove 67 defines a pocket within the socket member 66 which allows limited pivoting movement of the ball member 64 within the socket member 66. The groove 67 allows pivoting movement of the table 42 from the knife edge position, as shown in FIG. 4 to the horizontal working position as shown in FIG. 3. That is, the groove 67 permits movement of the table 42 from the Y-Z plane to the X-Z plane and does not permit further pivoting movement of the table. When the table 42 is in the work position (X-Z plane) the arm 62 engages the back wall of the socket member 66 and, therefore, the table 42 cannot be further rotated.

The assembly 10 further includes wedge means in the form of a wedge member 68 for frictionally engaging the rod 58 when the table 42 horizontal work position (X-Z plane, as viewed in FIG. 3). The wedge member 68 has a generally T-shaped cross section when viewed on end. The head of the T is fixedly secured to the bottom side 46 of the table 42. Preferably, the wedge member 68 extends downwardly from the rear portion of the table 42. The leg of the wedge T-member 68 is for frictionally engaging the rod 58 and maintaining the table 42 in the horizontal work position (FIG. 7).

The assembly 10 further includes hold down means for frictionally engaging the arm 62 when the table 42 is in the upright stored position (as best viewed in FIG. 1). The hold down means includes a flange 70 depending from the bottom side 46 of the table 42. The flange 70 has a notched portion 72 for receiving the arm 62 when the table 42 is in the upright stored position (as viewed in FIG. 1). The flange 70 frictionally engages the arm 62.

Figure 2:
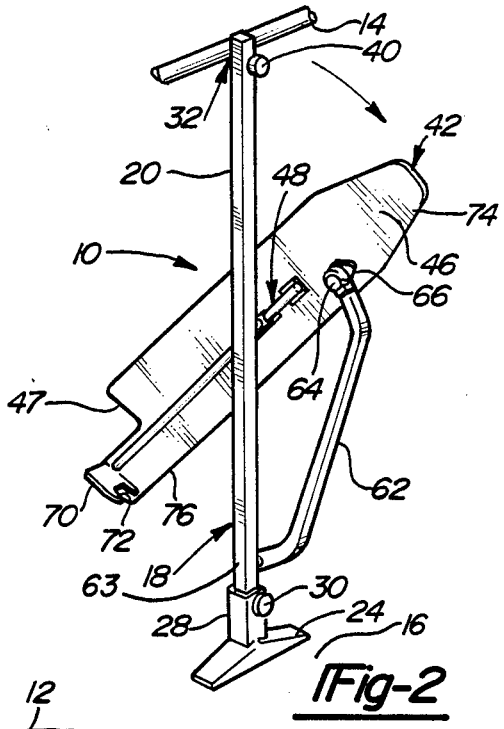
FIG. 2 is a perspective view of the subject ironing table as being moved from the upright storage position to the knife edge position.

In operation, the tubular support member 20 is disposed within the upright member 28 which extends upwardly from the foot portion 24. The knob 30 is tightened when the desired height of the tubular support member 20 is reached. The hook member 34 is then placed about a closet rod 14 and disposed through the tubular support member 20. The clamping handle 40 is then tightened onto the threaded portion 36 of the hook member 34 thereby securing the hook member 34 and tubular support member 20 with the closet rod 14. The table 42 is secured to the support member 20 as previously described. A forward manual force is then applied to the front portion 74 of table 42. The force must be strong enough to overcome the frictional engagement of the flange 70 with the arm 62. The table 42 will then rotate downward in the Y-Z plane about the X axis as viewed in FIG. 2. As the table 42 is being rotated, it is further moving outwardly, i.e., away from the support member 20 in the Y-Z plane. The arm 62 guides this forward pivoting and translational movement of the table 42. This translation movement is effective by the rod 58 sliding relative to the second tubular portion 54. This allows the table 42 to be moved outwardly and away from the tubular support member 20. Again, the arm 62 defines the arcuate path with which the table 42 follows The downward pivoting movement of the table 42 is limited by the bushing 60 located at the rear portion of the table 42. When the second tubular portion 54 engages the rear bushing 60, forward pivoting movement of the table 42 ceases. This occurs when the longitudinal axis of the board is parallel to the Z axis. When pivoting movement is stopped, the table 42 is in the knife edge position The table can then be pivoted from the knife edge position (the position in the Y-Z plane to the lower work position the X-Z plane, as viewed in FIG. 3). The table 42 will pivot no further than the horizontal position because the socket member 66 limits pivotal movement of the board to the working position For stability, as the board is rotated from the knife edge position (Y-Z plane) to the working position (X-Z plane) the wedge member 68 engages the rod 58 for securing the table 42 in the working position To return the table 42 to the upright stored position, the board 42 is rotated from the horizontal position to the knife edge position The board is then rotated about its longitudinal axis (X axis) from the knife position to the upright stored position. Upright pivoting movement is limited by the flange 70 which engages the arm 62 when the table 42 has reached the upright stored position.

Accordingly, there is provided an ironing table assembly 10 of the type for storing in a closet having a lower support or floor 16 and an upper support or closet rod 16. The assembly generally includes an ironing table 42 and a closet support structure 18. The closet support structure 18 is for fixed connection between the closet floor 16 and closet rod 14. The closet support structure 18 is further for supporting the ironing table 42 in a folded condition (FIG. 1) wherein the ironing table 42 is supported in a vertical position and an extended position (FIG. 3) wherein the ironing table 42 extends horizontally and outwardly from the closet.

In this manner, there is provided an assembly 10 which is easily adaptable to be mounted in a closet 12. Since the table 42 is stored in a vertical position it does not occupy a large amount of space in the closet 12. Finally, the table 42 can be rotated outwardly from the closet 12 to present a horizontal working position adjacent the closet 12 opening.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. An ironing table assembly (10) for movements between a vertical stored position and a horizontal work position, said assembly (10) comprising: support means (18) for supporting said assembly (10) from a fixed structure (16) and having fore and aft sides; ironing table means (42) including a work surface (44) and a longitudinal axis through the length thereof and having a vertical position relative to said support means wherein said work surface (44) defines a vertical plane (Y-Z) extending for and aft relative to said support means and a horizontal work position wherein said work surface (44) is in a second longitudinal plane (X-Z) which is substantially perpendicular to said vertical for and aft plane; and characterized by including pivot means for interconnecting said support means (18) and said table means (42) and for pivoting said table means from said vertical position through said vertical plane while simultaneously pivoting about said longitudinal axis of said table means to said horizontal work position, said pivot means including two spaced connections between said ironing table means (42) and said support means (20), said first of said connections including a track member fixedly attached to said ironing table means (42) and guide means (50, 54) rotatably connected to said support means (20) and in sliding engagement with said track member for allowing sliding and rotational movement of said track member through said guide means as said ironing table means (42) moves through said vertical plane and rotates about said longitudinal axis, said second of said connections including an arm (62) having a first end pivotally connected to said support means (20) for pivoting movement relative to said support means (20) only in said vertical plane (Y-Z) and a second end having a universal joint connection with said ironing table mans (42).

2. An assembly as set forth in claim 1 further characterized by said connection between said table means (42) and said arm (62) including stop means (66) for limiting the rotational movement of said table means (42) about said longitudinal axis of said table means (42) to said horizontal work position.

3. An assembly as set forth in claim 2 further characterized by said table means (42) having a bottom surface (46) and including wedge means (66) mounted on said bottom surface (46) for frictionally engaging said track means when said table member (42) is in said horizontal work position to maintain said table means (42) in said horizontal work position.

4. An assembly as set forth in claim 3 further characterized by said bottom surface (46) including hold down means (70) extending therefrom for frictionally engaging said arm (62) when said table means (42) is in said vertical stored position to retain said table means (42) in said upright stored position.

5. An assembly as set forth in claim 2 further characterized by said support means (18) including clamping means (32) for fixedly securing said support means (18) to an upper support structure (14).

6. An assembly as set forth in claim 5 further characterized by said support means (18) including height adjustment means (22) adapted for connection to a lower support structure (12) for adjusting the height of said support means (18) relative to the lower support structure.

7. An assembly as set forth in claim 6 further characterized by said support means (18) further including a tubular support member (20) extending between said clamping means (32) and said height adjust means (22).

8. An assembly as set forth in claim 7 further characterized by said guide means (50,54) including a first tubular portion (50) rotationally secured to said support member (20) and a second tubular portion 54 transverse to said first tubular portion 50 and fixedly secured thereto.

9. An assembly as set forth in claim 8 further characterized by said track means (58) including a rod (58) fixedly secured to said table means (42) and spaced therefrom, said rod (58) slideably retained by said second tubular portion (54).

10. An assembly as set forth in claim 9 further characterized by said table means (42) including a table (42) having a top side (44) and a bottom side (46) and having forward and rear portions.

11. An assembly as set forth in claim 10 further characterized by said rear portion having a recess (47) therein, said tubular support member (20) being disposed in said recess (47) when said table (42) is in said horizontal work position.

12. An assembly as set forth in claim 11 further characterized by said stop means (66) including a socket member (66) fixedly secured on said bottom side (46) of said table means (42) said arm (62) having first and second ends, said first end being pivotally secured to said tubular support member (20) and said second end defining a ball shaped portion, aid ball shaped portion (64) being seated within said socket member (66) for universal movement relative thereto.

13. An assembly as set forth in claim 12 further characterized by said socket member (66) having a groove (67) therein for permitting said ball member (64) to pivot within said groove (67) as said table (42) is moved between said vertical stored position and said horizontal working position.

14. An assembly as set forth in claim 13 further characterized by said wedge means (68) including a wedge portion (68) extending downwardly from said bottom side of said table (42).

15. An assembly as set forth in claim 14 further characterized by said wedge member (68) having a generally T-shaped cross section when viewed on end.

16. An assembly as set forth in claim 14 further characterized by said hold down means (70) including a flange (70) depending from said bottom side of said table (42), said flange (70) having a notched portion (72) for receiving said arm (62) when said table (42) is in said vertical stored position.

17. An assembly as set forth in claim 16 further characterized by said clamping means (32) including a hook shaped member (34) for engaging the upper support structure (14), said hook shaped member (34) including a threaded portion (36) for extending through said tubular support member (20).

18. An assembly as set forth in claim 17 further characterized by said clamping means (32) including a clamping handle (40) for mating engagement with said threaded portion (36) of said hook member (34) for securing said hook member (34) with said tubular support member (20).

19. An assembly as set forth in claim 18 further characterized by said height adjustment means (22) including a foot member (24) having a base (24) adapted for securing to the lower support structure (16) and an upright member (28) extending upwardly and transverse to said base (24) for engaging said tubular support member (20).

20. An assembly as set forth in claim 19 further characterized by said height adjustment means (22) further including a height adjustment knob (30) having a male threaded portion thereon, said male threaded portion for frictionally engaging said tubular support member (20) and preventing movement thereof.

* * * * *